US006109257A

United States Patent [19]

Hodge et al.

[11] Patent Number: 6,109,257

[45] Date of Patent: Aug. 29, 2000

[54] MODULAR CHIMNEY

[76] Inventors: Deborah L. Hodge; James Roe Hodge, Jr., both of 4880 Northside Dr., NW., Atlanta, Ga. 30327

[21] Appl. No.: 09/121,743

[22] Filed: Jul. 23, 1998

[51] Int. Cl.[7] ..... F24B 1/18; E04D 13/14; E04B 5/48

[52] U.S. Cl. ..... 126/500; 52/219; 52/218; 52/503; 52/504

[58] Field of Search ..... 126/500; 52/219, 52/218, 503, 504, 505

[56] References Cited

U.S. PATENT DOCUMENTS

| | | | |
|---|---|---|---|
| 625,756 | 5/1899 | Glover | 52/219 |
| 751,534 | 2/1904 | Minger | 52/218 |
| 854,895 | 5/1907 | Kemp | 52/204 |
| 915,123 | 3/1909 | Spaulding | 52/218 |
| 933,774 | 9/1909 | Maschino | 52/219 |
| 1,297,652 | 3/1919 | Brunner | 52/204 |
| 1,342,918 | 6/1920 | Legg | 52/218 |
| 1,566,233 | 12/1925 | Separk | 52/218 |
| 2,128,463 | 8/1938 | Kauffmann | 52/218 |
| 3,303,618 | 2/1967 | Kelsey | 52/218 |
| 3,721,225 | 3/1973 | Tidwell | 126/500 |
| 4,466,420 | 8/1984 | Ernisse et al. | 126/500 |
| 4,470,399 | 9/1984 | Pitha | 126/500 |
| 4,478,208 | 10/1984 | Pitha | 126/500 |
| 4,984,562 | 1/1991 | Pedersen et al. | 126/500 |
| 5,186,161 | 2/1993 | Shumock | 126/500 |

FOREIGN PATENT DOCUMENTS

| | | | |
|---|---|---|---|
| 0589638 | 6/1947 | United Kingdom | 126/500 |

*Primary Examiner*—Ira S. Lazarus
*Assistant Examiner*—David Lee
*Attorney, Agent, or Firm*—Needle & Rosenberg, P.C.

[57] ABSTRACT

The present invention encompasses a modular chimney having a fireplace, a smoke chamber, and a plurality of modular blocks, forming at least one stack of blocks, the stack of modular blocks defining a chimney passage that is in fluid communication with the smoke chamber for the passage of combustion products. Alternatively, in a second embodiment, the modular chimney may also include a plurality of angled blocks, forming at least one angled stack of angled blocks, the angled stack of angled blocks defining an angled chimney passage that is in fluid communication with the smoke chamber and the chimney passage. The modular chimney may also have a top plate that is disposed onto the upper surface of the smoke chamber and, upon which, the stack of modular blocks or the stack of angled blocks may be disposed, and the chimney may also have a ledger block, interposed between two stacks of modular blocks, so that a desired exterior surface treatment may be supported when it is applied to the exterior of the modular chimney. The modular sections of the top plate, the modular block, the angled block, and the ledger block are engaged in a nesting relationship that serves to orient the respective modular sections, to provide structural support to the modular sections and the modular chimney, and to provide a physical obstruction to the passage of flame, hot gases, and smoke through the joints of the modular sections when the sections are physically joined and mortared together.

20 Claims, 6 Drawing Sheets

MODULAR CHIMNEY

BACKGROUND OF THE INVENTION

1. Field of the Invention

The present invention relates to modular chimney systems and, more particularly, to a modular chimney flue construction that does not require a flue lining and does not deteriorate with heating and cooling.

2. Background Art

The design and construction of an efficient, functional fireplace requires adherence to some basic rules concerning dimensions and the placement of various component parts. The objectives of a correctly designed fireplace are to: (1) assure proper combustion of the fuel; (2) deliver smoke and other products of combustion up the chimney; (3) radiate the maximum amount of heat into the room; and (4) afford simplicity and fire safety in construction.

The first of the two objectives are closely related and depend mainly upon the shape and dimensions of the combustion chambers, the proper locating of the fireplace throat and the smoke shelf, and the ratio of the chimney flue area to the area of the fireplace opening. The third objective depends upon the dimensions of the combustion chamber, while the fourth depends upon the size and shape of the masonry units and their ability to withstand high temperatures without warping, cracking or deterioration.

The shape of the combustion chamber influences both the draft and the amount of heat that will be radiated into the room. The slope at the back throws the flame forward and leads the gases with increasing velocity through the fireplace throat and into the chimney flue. It is desirable, for the proper draw of products of combustion up the chimney, to obtain relatively high velocities of through the fireplace throat and the chimney flue. The velocities of combustion products is reduced, with a corresponding decrease in energy efficiency of the fireplace, if the chimney flue surface of the chimney has other openings, connections, or is rough.

Older methods of chimney construction, such as brick and mortar construction, typically result in a rough textured surface as if is difficult to maintain a smooth surface with the multitude of joints that result from the brick and mortar construction. Hence, the use of a flue lining is recommended for these types of chimney construction in order to provide a smooth interior surface and thereby provide a more efficient operation of the flue. An additional problem that plagues brick and mortar chimneys without flue linings is that portions of the chimney may have to be rebuilt every few years due to the disintegrating effect of smoke and gases on the mortar. This is a costly repair as the brick chimney must be taken down to a point where the mortar joints are solid and a new top rebuilt. This disintegration of an unlined chimney also poses a safety hazard as products of combustion can escape the confines of the chimney flue into the surrounding construction materials, which are typically wood frame construction, thus causing a fire safety hazard.

A chimney made of brick, with a flue liner to increase efficiency, is a difficult and costly construction. Flue liner sections are typically mortared, with a simple butt joint, onto the proceeding flue liner before the brickwork has reached the top of the flue liner section below, and then the brick built up around them. Where offsets or bends are necessary in the chimney, they are normally formed by equally mitering both ends of abutting sections of flue lining in order to prevent any reduction of the flue area, since it is important that the same effective flue area be maintained the whole height of the flue. The difficulty of making all of the joints in both the flue lining and the surrounding masonry construction free from leaks that can form a safety hazard require the use and expense of a skilled artisan. Any open joint must be repaired and, since such repairs are usually difficult, the expense of a typical brick masonry chimney is compounded.

A chimney made of metal tubing is less expensive to construct than the typical brick and mortar construction. A metal chimney also offers the advantage of providing a smooth surfaced chimney flue. However, a metal chimney does not dissipate heat readily and can present a fire hazard to surrounding construction materials. Also, a metal chimney is susceptible to deterioration over time due to the changing temperature and heat load produced by the fireplace resulting in cracks, leaks and rust in the metal chimney. This deterioration of a metal chimney can cause a fire safety hazard as the chimney warps and moves under the heat load produced by the fireplace, which results in the requirement to eventually remove and replace the metal chimney.

Consequently, there exists a need in the art for a chimney such as a modular chimney construction that does not require a flue liner and that does not deteriorate with heating and cooling, which is nested for structural stability and to ensure a no leak seal so as to eliminate any possible passage of flame through the joints of the modular chimney construction, and allows for proper combustion of the fuel and the efficient delivery of smoke and other products of combustion up the chimney while also providing ease of construction, enhanced fire safety and life expectancy of the chimney construction.

SUMMARY OF THE INVENTION

The present invention overcomes the disadvantages of the prior art. Specifically, the present invention encompasses a modular chimney construction that does not require a flue liner and that does not deteriorate with heating and cooling. The modular chimney is also nested for structural stability and to ensure a substantially no-leak seal which prevents the passage of smoke or flame through the joints of the modular chimney. Moreover, the modular chimney can have both vertical and angles sections as required by the surrounding building construction structure. Furthermore, the modular chimney is simple and easy to construct and requires minimal labor and masonry expertise.

The present invention encompasses a modular chimney having a fireplace, a smoke chamber, and a plurality of modular blocks, forming at least one stack of blocks, that are in fluid communication with the smoke chamber. Typically, if a top plate is used, the lower surface of a top plate is disposed onto the upper surface of the smoke chamber. This allows the bore of the top plate to be in fluid communication with the exhaust opening of the smoke chamber. A modular chimney block is then placed onto the top plate in a nesting relationship. The nesting relationship serves to structurally support the joint between the top plate and the block and provides a physical obstruction to the passage of smoke and flame through the joint. The upper surface of the top plate has a male top plate protrusion and the bottom surface of the chimney block has a female block indentation, the complementary shapes of which aids in the orientation of the block and allows the block to engage and fit snugly onto the top plate. This snug fit between the block and the top plate also ensures that the bore of the block is substantially co-axially aligned with the bore of the top plate bore.

Subsequent courses of the modular blocks are then sequentially laid with the female block indentation within the bottom surface of each block engaging and snugly fitting onto the male block protrusion of the previously laid course of the block. Similar to the nesting relationship between the top plate and the block that was disposed onto the top plate, and serving the same nesting purposes described above, the nesting relationship of the female block indentation of one block and the male block protrusion of the adjacent block ensures that the stack of blocks formed from the sequential stacking of the blocks forms a substantially smooth and uniform chimney passage in which the bores of the blocks are substantially co-axially aligned with each other.

Approaching the roof line, if an exterior decorative surface treatment such as brick is desired to be applied to the chimney, a ledger block is disposed onto the preceding course of the block. The female ledger block indentation within the lower surface of the ledger block is placed onto, and complementarily engages, the male block protrusion of the preceding course of the block. To continue the chimney, the female block indentation within the bottom surface of one of the blocks is then placed onto, and complementarily engages, the male ledger block protrusion extending from the upper surface of the ledger block. Additional courses of the block may be sequentially applied, as discussed above, until the desired height of the chimney is achieved.

Similar to the nesting relationship between adjoining blocks and serving the structural support and physical obstruction purposes described above, the nesting relationship of the female block indentation of one block and the male ledger block protrusion of the ledger block and the nesting relationship of the male block protrusion of one block and the female ledger block indentation of the ledger block ensures that the sequential stacking of the blocks and the ledger block continues the substantially smooth and uniform chimney passage in which the block bores are substantially co-axially aligned with each other and the ledger block bore. The ledger surface of the ledger block also provides a structural support for the application of an exterior surround of bricks.

Angled block may be used if the chimney construction requires the use of an angled chimney or an angled section of chimney. To form the angled section of block, a plurality of angled blocks, forming an angled stack of angled blocks when the angled blocks are sequentially stacked, is interposed between two stacks of modular blocks, or, more particularly, between two modular blocks. A spacer block is used in the transition from the substantially vertical section of modular blocks to the angled section. The spacer block is placed onto the top surface of the block. The spacer block opening has a complementary square shape to the male block protrusion of a block. This complementary shape of the spacer block opening orients the spacer block and allows the spacer block to engage and fit snugly onto the block. When the spacer block is engaged with the block, the top surface of the spacer block and the top of the male protrusion on the top surface of the block form a substantially co-planar spacer block mounting surface that provides structural support for the angled block. The bottom surface of an angled block is then oriented and disposed onto the mounting surface while ensuring that the angled bore of the angled block is positioned over the bore of the adjacent block so that the angled bore and the block bore are substantially aligned so that the flow of combustion products is not obstructed.

Subsequent courses of angled blocks are then laid onto each other, with the assembler ensuring that when the angled block bottom surface of one angled block is lowered and fit onto the angled block top surface of a preceding course of the angled block, the angled bores of the adjoining angled blocks are substantially co-axial aligned with each other. The sequential stacking of angled blocks forms substantially smooth and uniform angled chimney passage in which the angled block bores are substantially co-axially aligned with each other.

When the chimney has been sufficiently offset to clear any intervening physical obstruction, a return to the use of the blocks allows the resumption of substantially vertically oriented construction of the chimney. When it is desired to return to use of the blocks, a filler block is used. The filler block lower surface is placed onto the angled block top surface of the preceding course of the angled block with the assembler ensuring that the filler block bore is aligned with the angled bore of the preceding course of the angled block. The filler block is sized and shaped to complementarily engage, and fit within, the female block indentation of the bottom surface of one of the blocks. Thus, the engagement of the filler block onto the angled block top surface allows the filler block to function in the "nesting relationship" substantially the same as the male block protrusion of the block functions with the female block indentation of one adjacent block.

The bottom surface of a block is then placed onto the top surface of the preceding course of the angled block and the top surface of the filler block. When the block is seated onto the top surface of the preceding course of angled block, the filler block, being sized and shaped to complementarily match the female block indentation within the bottom surface of the block, is engaged and is snugly fitted within the female block indentation. This ensures that the block bore is substantially co-axially aligned with the filler block bore which, in turn, ensures a smooth transition from the angled chimney passage formed by the angled blocks to the chimney passage formed by the blocks. The angled block can be used any time that it is it is desired to offset the chimney. All that is required is the use of one spacer block and one filler block at the respective beginning and end of any sequential stack of angled blocks.

The modular chimney is preferably made of a lightweight concrete composition which can withstand the extreme heat-resistance required of the chimney without deterioration. The lightweight nature of the modular sections of the chimney also allows for ease of assembly. All of the joints in the between the adjoining modular sections of the chimney are preferably mortared with a high-temperature mortar to aid in providing a substantially smoke and flame proof seal.

DETAILED DESCRIPTION OF THE INVENTION

The present inventions is more particularly described in the following examples that are intended as illustrative only since numerous modifications and variations therein will be apparent to those skilled in the art. As used in the specification and in the claims, "a" can mean one or more, depending upon the context in which it is used.

The present invention provides an improved chimney construction in the form of a modular chimney 10 that is adapted for use without a flue liner. The modular chimney 10 saves labor and installation time by providing modular sections whose shape and size make it readily apparent to the assembler in what order, and how, the individual sections are connected. The shape and size of the modular sections also ensures that the connection between the individual sections will be secure and that the chimney flue of the chimney 10 is smooth and free of obstructions. The size and shape of the modular sections also provides a substantially no-leak seal which prevents the passage of combustion products, such as hot embers and gases, through the joints of the modular sections. Simplicity and ease of assembly is also achieved by the use of easy to handle sections.

Figure 1:
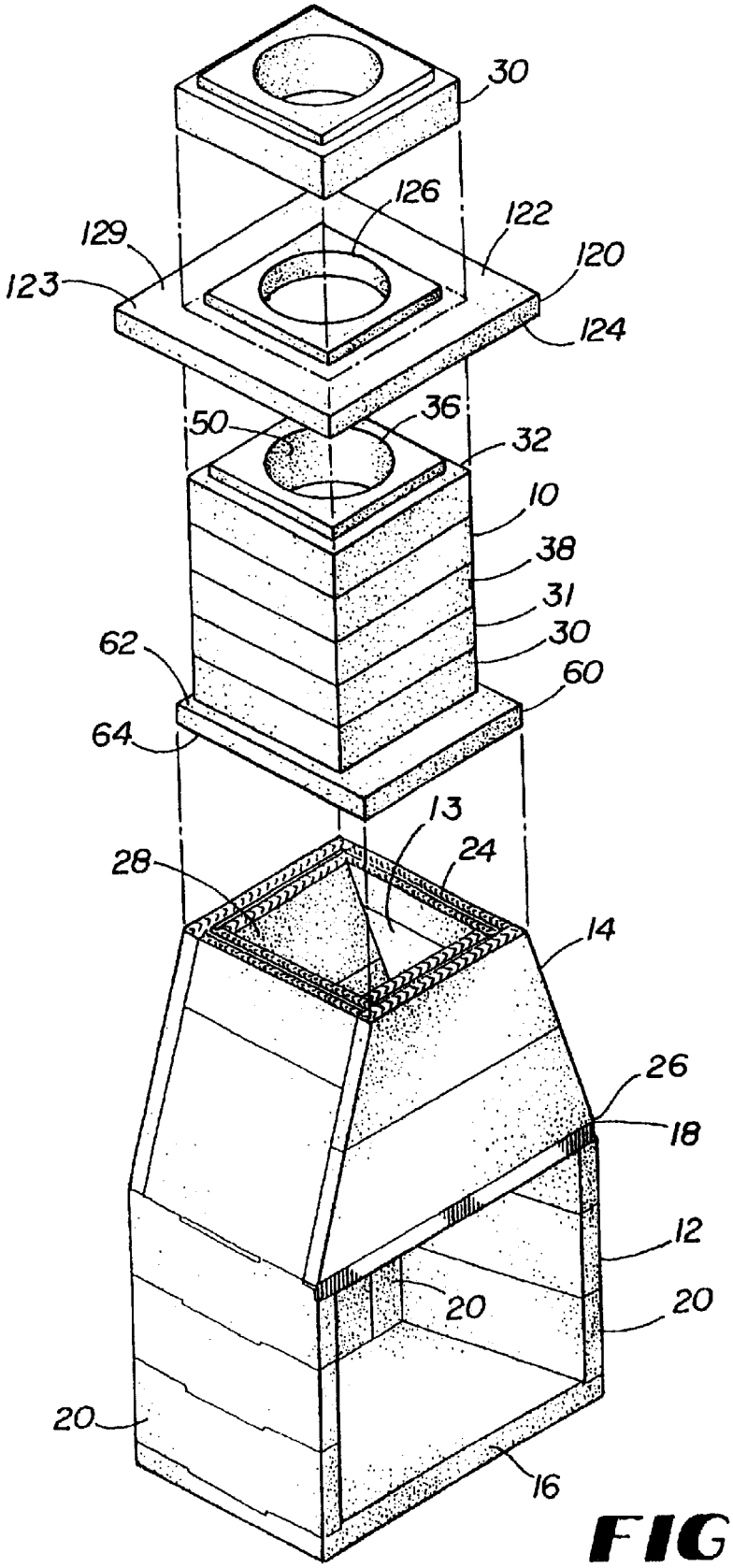
FIG. 1 is an exploded perspective view of the first embodiment of the chimney of the present invention.
Figure 2:
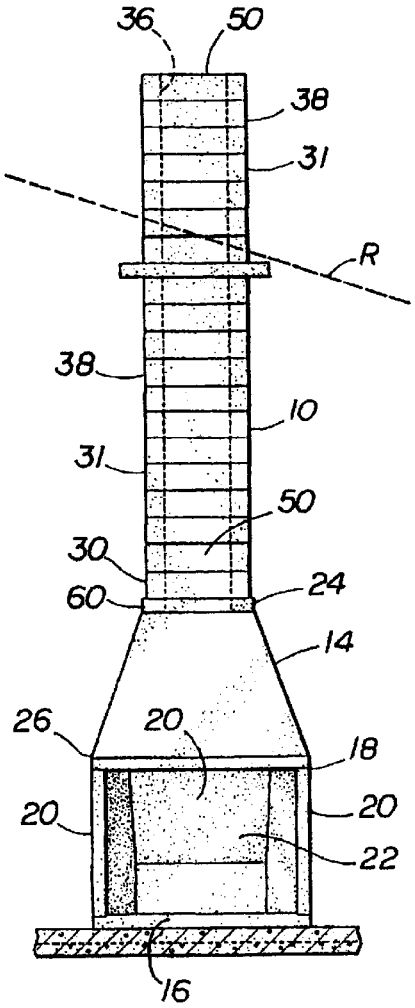
FIG. 2 is a side elevational view of the first embodiment of the chimney of the present invention.

Referring to FIG. 1, the chimney 10 of first embodiment of the present invention is shown in an exploded perspective view disposed onto a smoke chamber 14 of a fireplace 12. Prior to constructing the modular chimney 10, a fireplace 12 and its associated smoke chamber 14 must be constructed. As shown in FIG. 2, a typical fireplace 12 has a bottom end 16 and a top end 18 with three walls 20. The "U" shaped structure of the three walls 20 of the fireplace 12 defines a firebox region 22 in which combustible materials are burned. Alternatively, in an embodiment that is not shown, a fireplace 12 could have only two opposing walls 20, thereby allowing the firebox region 22 to be seen in two opposing rooms.

Referring back to FIG. 1, upon completion of the fireplace 12, a smoke chamber 14, having an upper surface 24 and a lower surface 26, is constructed. The lower surface 26 of the smoke chamber 14 is disposed onto the top end 18 of the fireplace 12. The smoke chamber 14 is typically an enclosed construction with a hollow interior 13 that acts to gather and funnel the products of combustion towards an exhaust opening 28 defined by the upper surface 24 of the smoke chamber 14. Preferably, the cross-sectional area of the smoke chamber 14 decreases when comparing the portion of the smoke chamber 14 closest to the lower surface 26 of the smoke chamber 14 to the portion of the smoke chamber 14 closest to the upper surface 24 of the smoke chamber 14.

Figure 3:
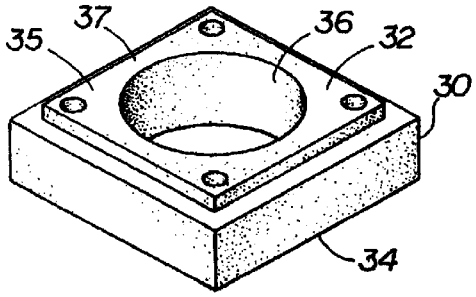
FIG. 3 is a perspective view of a modular block showing the male block protrusion extending from the block top surface and showing the block bore.
Figure 4A:
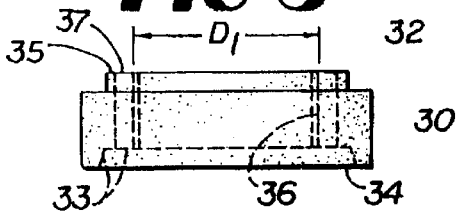
FIG. 4A is a side elevational view of the modular block of the present invention.
Figure 4B:
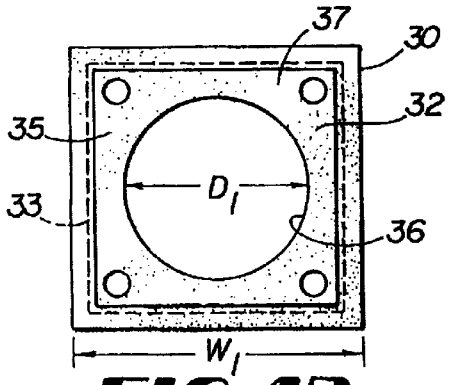
FIG. 4B is a top plan view of the modular block of the present invention showing the preferred round cross section of the block bore.

As shown in FIGS. 1 and 2, the chimney 10 has a plurality of modular blocks 31. The modular blocks 30 are sequentially stacked to form at least one stack of blocks 38. The plurality of blocks 31 is in fluid communication with the exhaust opening 28 of the smoke chamber 14. Referring now to FIGS. 3, 4A and 4B, each block 30 of the chimney 10 has a first cross-sectional width W1, a block top surface 32, and an opposed block bottom surface 34. Preferably, the block top and bottom surfaces 32, 34 of the block 30 are substantially planar and parallel to each other. Each block 30 further has a block bore 36, having a first diameter D1, extending through the block 30 between the block top surface 32 of the block 30 and the block bottom surface 34 of the block 30. The block bore 36 preferably extends substantially perpendicular relative to the block top surface 32 and the first bottom surface 34.

Referring now to FIGS. 1 and 2, the block top surface 32 of one block 34 is sized to complementarily engage the block bottom surface 34 of one adjacent block 30 so that the blocks 30 can be sequentially stacked in a nesting relationship in which the block bore 36 of each block 30 substantially co-axially aligns with the block bores 36 of the blocks 30 in the stack of blocks 38 to form a chimney passage 50 that extends through the stack of blocks 38. Thus, as one skilled in the art will appreciate, when the plurality of blocks 30 is disposed onto the smoke chamber 14, the chimney passage 50 is in fluid communication with the exhaust opening 28 of the smoke chamber 14. As shown in FIG. 3, it is also preferred that the block bore 36 of the block 30 have a cylindrical cross-section and, as shown in FIG. 4B, the block bore 36 also preferably has a round cross-section from a top plan view. This cross-sectional shape enhances the flow of exhaust gas through the chimney passage 50 as there are no "corners" forming drag inducing turbulence.

The nesting relationship used in the blocks 30 enhances the stability of the chimney 10 and provides a physical obstruction to the passage of flame or combustion products through the joints of blocks 30 in the stack 38 of the chimney 10. Now referring to FIGS. 3, 4A and 4B, to provide the nesting relationship between adjoining blocks 30, each block 30 preferably includes a male block protrusion 35 extending from the block top surface 32 of the block 30 and a female block indentation 33 therein the block bottom surface 34 of the block 30. The male block protrusion 35, having a top block protrusion surface 37, of the block 30 is sized to complementarily engage one female block indentation 33 so that the blocks 30 can be sequentially stacked in the nested relationship. The male block protrusion 35 of the block 30 extends and surrounds the block bore 36 of the block 30 and the female block indentation 33 of the block 30 surrounds the block bore 36 of the block 30 so that the substantial co-axial alignment of the block bores 36 is easily achieved when a block 30 is laid upon a proceeding block 30. The male block protrusion 35 and the female block indentation 33 also provides a physical obstruction to the passage of flame or smoke through the joint of the blocks 30 when the blocks 30 are engaged in the nested relationship.

As shown in FIG. 3, the preferred shape of the male block protrusion 35 and the female block indentation 33 is a substantially square shape. However, as one skilled in the art will appreciate, the chosen shape of the male block protrusion 35 and the female block indentation 33 could be any complementary shapes, such as circles, ovals, rectangles, or random complementary figure shapes, as long as the chosen shape completely surrounds the block bore 36 so as to provide the desired physical obstruction to the passage of flame or the products of combustion.

Figure 5:
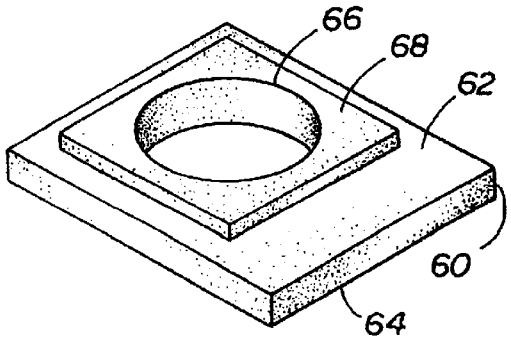
FIG. 5 is a perspective view of a top plate of the present invention showing the male top plate protrusion extending from the top plate upper surface and showing the top plate bore.

Referring to FIGS. 2 and 5, the stack of blocks 38, or, more particularly, one of the blocks 30, is preferably disposed, in a nesting relationship, onto a top plate 60 which, in turn, is preferably disposed onto the upper surface 24 of the smoke chamber 14 of the fireplace 12. The top plate 60 of the chimney 10 has a top plate upper surface 62 and an opposed top plate lower surface 64 that are preferably substantially planar and parallel to each other. The top plate 60 further has a top plate bore 66 extending, preferably substantially perpendicular to the top plate upper and lower surfaces 62, 64, therethrough the top plate 60 between the top plate upper surface 62 and the top plate lower surface 64. The top plate bore 66 has a diameter that is preferably substantially the same as the first diameter D1 of the block bore 36.

The top plate lower surface 64 is sized such that upon disposition of the top plate lower surface 64 onto the smoke chamber upper surface 24, the exhaust opening 28 of the smoke chamber 14 is sealed except for the top plate bore 66. This allows the top plate bore 66 to be in fluid communication with the products of combustion at the exhaust opening 28 of the smoke chamber 14. As one skilled in the art will appreciate, the top plate 60 may be sized as required by the dimension of the exhaust opening 28 so that the smoke chamber 14 is sealed upon the disposition of the top plate 60 upon the smoke chamber upper surface 24.

As shown in FIGS. 1 and 5, the top plate 60 is preferably complementarily engaged in the nested relationship with a third block 30 of the stack of blocks 38. This nested relationship is achieved by sizing a portion of the top plate 60 adjacent the top plate upper surface 62 to complementarily engage the bottom surface 34 of the third block 30, so that when the third block 30 is disposed onto the top plate upper surface 62 in the nested relationship, the top plate bore 66 is in fluid communication with the exhaust opening 28 and the chimney passage 50 and in substantial co-axial alignment with the bore of the third block 30.

Preferably, the top plate upper surface 62 includes a male top plate protrusion 68 extending from the top plate upper surface 62 of the top plate 60. The male top plate protrusion 68 also preferably surrounds the top plate bore 66 of the top plate 60 so as to aid in the alignment of the top plate bore 66 and the block bore 36 of the third block 30. The male top plate protrusion 68 also prevents passage of flame or combustion products through the joint between the top plate upper surface 62 and the bottom surface 34 of the third block 30. The male top plate protrusion 68 is sized to complementarily engage one female block indentation 33 of the adjoining third block 30 so that the third block 30 can be stacked in the nested relationship with the top plate 60. As one skilled in the art will appreciate, the male top plate protrusion 68 is substantially shaped and sized the same as the male block protrusion 35 of the block 30 as both the male top plate protrusion 68 and the male block protrusion 35 are shaped and sized to complementarily engage one female block indentation 33 of a block 30.

It is contemplated that the stack of blocks 38, or, more particularly, one of the blocks 30 may be disposed onto the upper surface 24 of the smoke chamber 14 without the use of the top plate 60. If one of the blocks 30 is disposed onto the smoke chamber 14, it is preferred that the exhaust opening 28 of the smoke chamber 14 be sized so that upon the disposition of the block 30 onto the upper surface 24 of the smoke chamber 14 the block bottom surface 34 of the block 30 will substantially seal the exhaust opening 28. The block bore 36 would be in fluid communication with the exhaust opening 28.

Figure 6A:
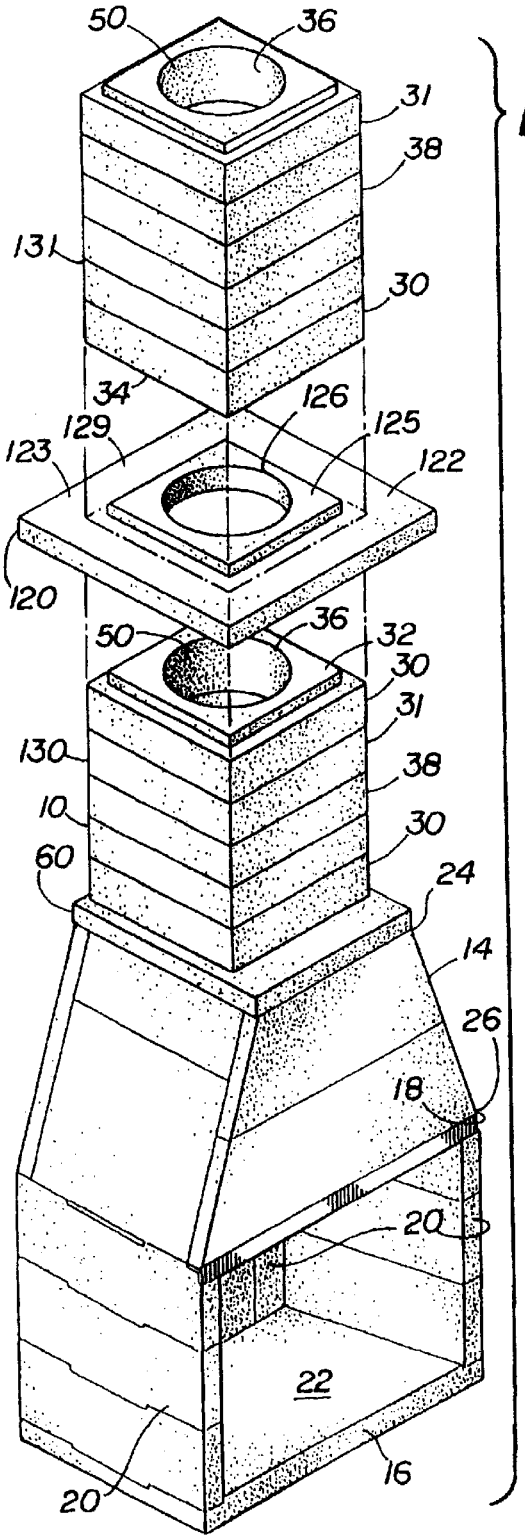
FIG. 6A is a partial exploded perspective of the chimney of the present invention showing a ledger block interposed between two stacks of modular blocks.
Figure 6B:
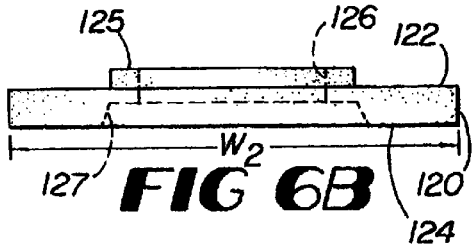
FIG. 6B is a side elevational view of the ledger block of the present invention.

Referring now to FIGS. 1, 6A and 6B, the chimney 10 may have a ledger block 120 so that an exterior course of decorative brick, stucco, or other exterior finishes, can be applied to the exterior of the ledger block 120 and the block 30, or stack of blocks 38, that are disposed onto the ledger block 120. As shown in FIGS. 6A and 6B, the ledger block 120 has a ledger block upper surface 122 and an opposed ledger block lower surface 124. The ledger block 120 further has a ledger block bore 126 having a diameter substantially the same as the first diameter D1 of the block bore 36, the ledger block bore 126 extending through the ledger block 120 between the ledger block upper surface 122 and the ledger block lower surface 124. Referring now to FIGS. 6A and 6B, the ledger block lower surface 124 is sized to be disposed on and to complementarily engage the block top surface 32 of a first block 30 of a first stack of blocks 130 and the ledger block upper surface 122 is sized to receive and to complementarily engage the block bottom surface 34 of a second block 30 of a second stack of blocks 131 that is subsequently stacked onto the ledger block 120, so that the ledger block 120 is in the nesting relationship with the adjacent first and second blocks 30. When the ledger block 120 is in the nesting relationship, the ledger block bore 126 is in substantial co-axial alignment with the first block bore 36 and the second block bore 36 of the adjoining first and second blocks 30 and in fluid communication with the chimney passage 50.

To provide the nesting relationship between the ledger block 120 and the adjoining blocks 30, the ledger block 120 has a male ledger block protrusion 125 extending from the ledger block upper surface 122 and a female ledger block indentation 127 therein the ledger block bottom surface 124. The male ledger block protrusion 125 is sized and shaped to complementarily engage the female block indentation 33 of the second block 30. Similarly, the female ledger block indentation 127 is sized and shaped to complementarily engage the male block protrusion 35 of the first block 30 so that the adjoining first and second blocks 30 and the ledger block 120 are stackable in the nested relationship.

As shown in FIGS. 1, 6A and 6B, the ledger block 120 also has a ledge 123. When the second block 30 is disposed onto the ledger block upper surface 122, the ledge 123 is defined. The ledge 123 is formed as a result of the ledger block 120 having a second cross-sectional width W2 that is greater than the first cross-sectional width W1 of the second block 30. The ledge 123 has a ledge surface 129 that allows bricks B, stone veneers, or other desired decorative surfacing, to be structurally supported when the bricks B are placed on the ledge surface 129.

Figure 7:
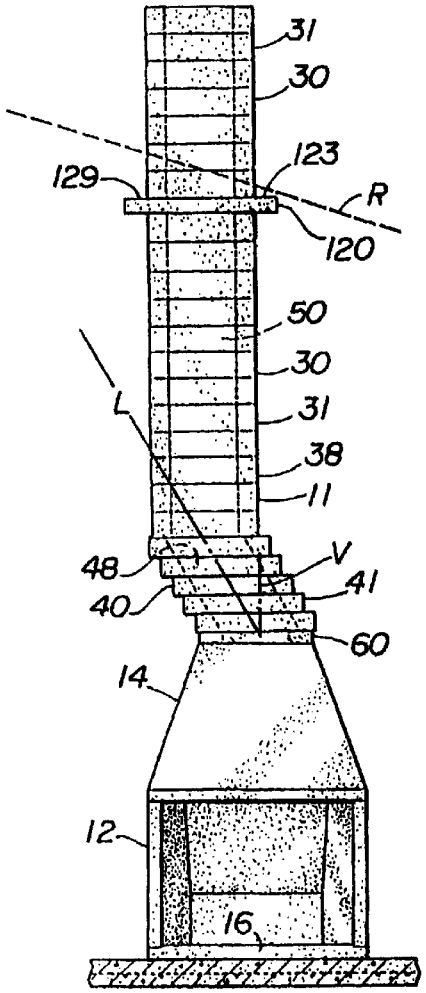
FIG. 7 is a front plan elevation view of the second embodiment of the chimney of the present invention showing a stack of angled blocks with an angled chimney passage.

FIG. 7 shows a second embodiment of a chimney of the present invention that allows for the construction of substantially vertical stacks of modular blocks 30 and for substantially angled stacks of angled blocks 40 so that the respective stacks of blocks and angled blocks can be substantially vertical or angled as the construction requires. The construction of the second embodiment is similar to the first embodiment and, accordingly, the figures use the same reference numerals for similar components. The fireplace 12, the smoke chamber 14, the plurality of modular blocks 31 and blocks 30, the ledger block 120, and the top plate 60 of the second embodiment of the present invention are substantially equivalent and, therefore, the description thereof is omitted for the second embodiment.

Figure 8:
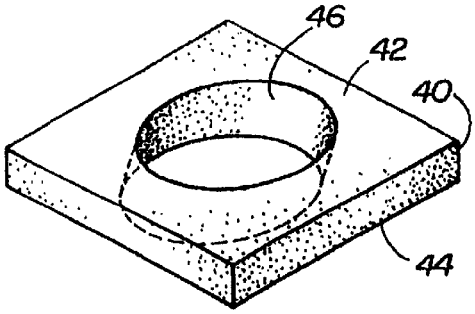
FIG. 8 is a perspective view of an angled block, showing the angled bore, that, when sequentially stacked, forms an angled stack of angled blocks with an angled chimney passage.
Figure 9:
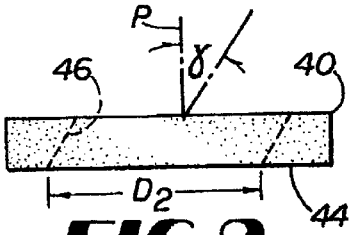
FIG. 9 is a side elevational view of the angled block showing the angled bore.

As shown in FIGS. 7–9, the second embodiment of the present invention further has a plurality of angled blocks 40, forming at least one angled stack 41, that may be used when the construction of the chimney 11 necessitates building the chimney 11 around physical obstructions. Each angled block 40 has an angled block top surface 42 and an opposed angled block bottom surface 44. Preferably, the angled block top surface 42 and the angled block bottom surface 44 are substantially planar and parallel to each other. Each angled block 40 further has an angled bore 46 having an angled bore diameter D2 substantially the same as the first diameter D1 of the block bore 36 of the block 30. The angled bore 46 of the angled block 40 extends therethrough the angled block 40 between the angled block top surface 42 and the angled block bottom surface 44 at an acute angle $\alpha$ relative to an axis perpendicular P to the angled block top and bottom surfaces 42, 44 of the angled block 40. This acute angle $\alpha$ of the angled block is preferably thirty degrees or less.

Figure 10:
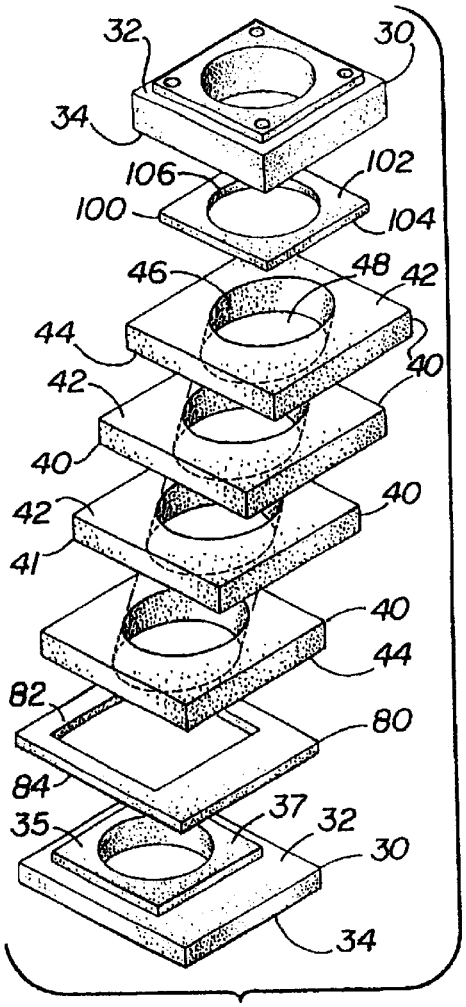
FIG. 10 is a partial exploded side view of the construction of the chimney of the present invention when it is desired to transition to and from the angled stack showing the angled blocks forming the angled stack, a filler block, a spacer block, and the modular blocks.

Referring to FIG. 10, the angled block top surface 42 of one angled block 40 is sized to complementarily engage the angled block bottom surface 44 of one adjacent angled block 40. The subsequent sequential stacking of the angled blocks 40, in which the angled bore 46 of each angled block 40 is substantially co-axially aligned with the angled bores 46 of the other angled blocks 40 in the angled stack 41, forms an angled chimney passage 48 extending through the angled stack 41. Referring to FIG. 7, the angled chimney passage 48 has a longitudinal axis L relative to a vertical plane V that is preferably substantially the same as the acute angle $\alpha$ relative to an axis perpendicular P to the angled block top and bottom surfaces 42, 44 of the angled block 40.

One angled block 40 is joined to one adjacent block 30 so that the angled stack of angled blocks 41 may be matingly engaged to the stack of blocks 38. As shown in FIG. 7, when the angled stack 41 is matingly engaged to the stack of blocks 38, the angled chimney passage 48 is in fluid communication with the chimney passage 50 of the stack of blocks 38.

Figure 11:
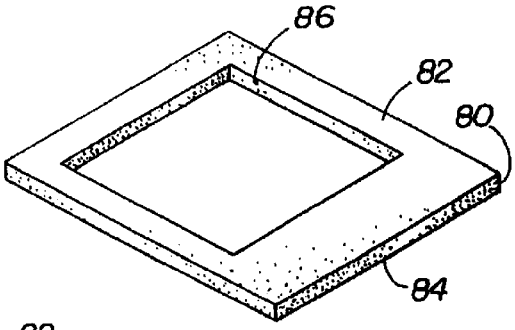
FIG. 11 is a perspective view of the spacer block showing the spacer block opening.

As shown in FIGS. 8 and 9, in the preferred embodiment, the angled block top surface 42 and the angled block bottom surface 44 do not have a protrusion or an indentation. As one skilled in the art would appreciate, an alternative embodiment of the angled block (not shown) could have both male and female mating devices similar to the male block protrusion 35 and the female block indentation 33 of the blocks 30. Referring now to FIGS. 10 and 11, in the preferred embodiment, when is desired to angle the chimney construction, a spacer block 80 is used to provide a spacer block mating surface 90 that is preferably substantially level for the engagement of the second bottom surface 44 of the angled block that is disposed onto the top surface 32 of one of the blocks 30, with its male block protrusion 35. The spacer block 80 has a spacer block upper surface 82 and a spacer block lower surface 84. The spacer block further defines a spacer block opening 86 extending, preferably substantially perpendicular to the spacer block top and bottom surfaces 82, 84, therethrough the spacer block 80 between the spacer block top surface 82 and the spacer block bottom surface 84.

Figure 12:
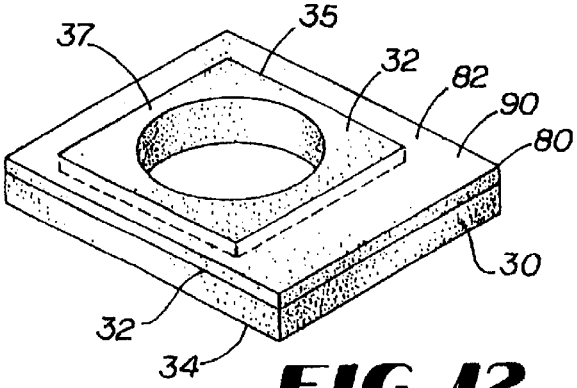
FIG. 12 is a perspective view of the spacer block disposed onto and engaged with the top surface of the modular block and showing the spacer block mounting surface.

The spacer block opening 86 is shaped and sized to complementarily engage and surround the male block protrusion 35 extending from the block top surface 32 of the block 30 so that the spacer block top surface 82 is substantially co-planar to the top block protrusion surface 37 of the male block protrusion 35 of the block top surface 32 of the block 30. As one skilled in the art will appreciate, and as shown in FIG. 12, the placement of the spacer block 80 onto the block top surface 32 of one of the blocks 30, results in a spacer block mating surface 90. The spacer block mating surface 90 is substantially horizontal and is sized to complementarily engage an angled block 40. The spacer block allows the angled block bottom surface 44 of one of the angled blocks 40 to be disposed onto, and complementarily engage, the spacer block mating surface 90 so that the block bore 36 of the adjacent block 30 is in fluid communication with the angled bore 46 of the angled block 40 and so that the chimney passage 50 smoothly transitions into the angled chimney passage 48. As one skilled in the art will appreciate, the use of the spacer block 80 allows the angled block bottom surface 44 of one of the angled blocks 40 to be disposed onto the spacer block mounting surface 90 without an undesirable void appearing within the mass of the chimney 11 that would otherwise result from the disposition of one angled block 40 onto the male protrusion 35 of one of the blocks 30 without the use of the spacer block 80. Such a void could result in an uneven heat transfer and a possible fire safety hazard due to combustion products, such as hot embers and gases, escaping through the void in the chimney 11 into the surrounding construction mass. Also, the use of the spacer block 90 and the resulting spacer block mounting surface 90 aids in the stability of the chimney 10 as the angled block 40 is disposed onto a solid, substantially co-planar, surface, i.e., the spacer block mating surface 90.

Figures 13, 14, 15:
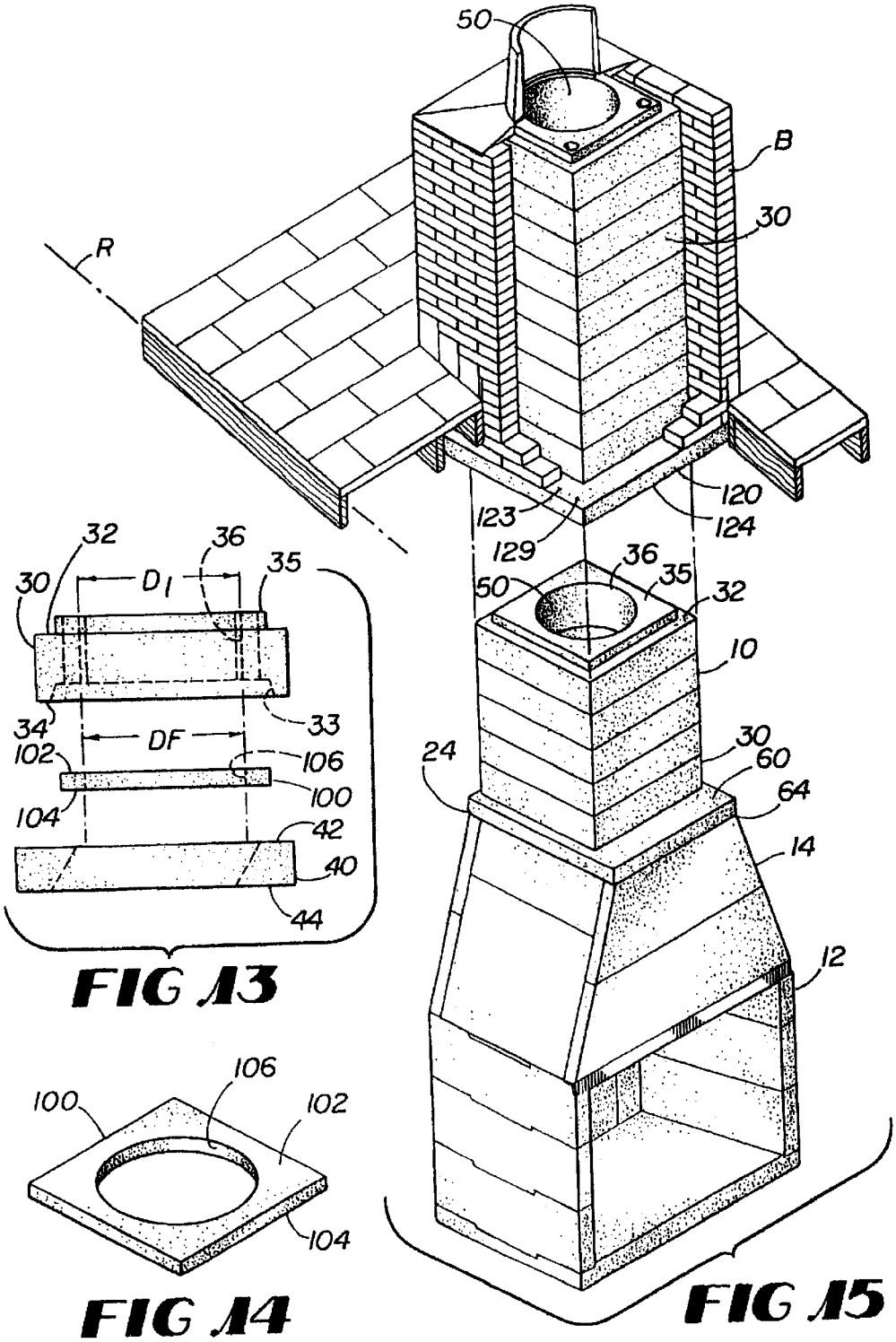
FIG. 13 is an exploded side elevation view of a filler block disposed onto the top surface of the angled block and the bottom surface of the modular block disposed onto the top surface of the angled block and the top surface of the filler block.
FIG. 14 is a perspective view of the filler block showing the filler block bore.
FIG. 15 is a exploded perspective view of the first embodiment of the present invention showing the chimney in perspective to the roof and a brick surround mounted onto the ledge surface of the ledger block.

Since, in the preferred embodiment, the angled block top surface 48 does not have a protrusion for effecting the nesting relationship that occurs between the male block protrusion 35 of a block 30 and the female block indentation 33 of one adjacent block 30, a filler block 100 is preferably used when is desired to transition from an angled construction, or stack 41, of angled blocks 40 to the substantially vertical construction, or stack 38, of blocks 30. As shown in FIGS. 10, 13 and 14, the filler block 100 is used when the block bottom surface 34 of one of the blocks 30 is disposed on the angled block top surface 42 of the angled block 40. The filler block 100 has a filler block upper surface 102, an opposed filler block lower surface 104, and a filler block bore 106 extending through the filler block 100 between the filler block upper surface 102 and the filler block lower surface 106. The filler block bore 106 has a diameter DF that is substantially the same as the first diameter D1 of the block bore. The filler block 100 is sized to complementarily engage, and fit within, the female block indentation 33 of the bottom surface 34 of one of the blocks 30.

As one skilled in the art will appreciate, the filler block 100 serves the same purpose as the male protrusion 35 of one of the blocks 30. Referring to FIGS. 10 and 13, when the filler block lower surface 104 of the filler block 100 is disposed onto the angled block top surface 42 of one angled block 40, a "male protrusion" is formed. The block bottom surface 34 of one block 30 may then be disposed onto the filler block upper surface 102 of the filler block 100 and the angled block top surface 42 of the angled block 20, in the same manner as the block bottom surface 34 of one block 30 is disposed onto the block top surface 32 of one adjacent block 30 when the blocks 30 are engaged in the nested relationship, so that one angled block 40, the filler block 100, and one block 30 can be stacked in a similar nested relationship. Also, when the filler block 100 is engaged within the female block indentation 33 of a block 30, the filler block bore 106 is substantially co-axially aligned with the block bore 36 and is in fluid communication with the angled bore 46 of the adjoining angled block 40. When used in the described fashion, the filler block 100 allows for the smooth transition from the use of the angled block 40 to the use of the block 30 and for the smooth transition of the angled chimney passage 48 to the chimney passage 50.

As one skilled in the art will appreciate, the filler block 100 acts to fill a void within the female block indentation 33 of the block 30 that would otherwise result from the disposition of one block 30, having a female indentation 33 within the block bottom surface 34 of the block 30, onto the angled block upper surface 48 of one of the angled blocks 40. Filling the void within the female block indentation 33 of the block 30 aids in preventing the escape of heat, flame or smoke products from the joint between the angled block 40 and the adjoining block 30. Also, the use of the filler block 100 helps to maintain the relative cross-sectional shape of the chimney passage 50, thereby aiding the efficient exhaust of the combustion product.

Figure 16:
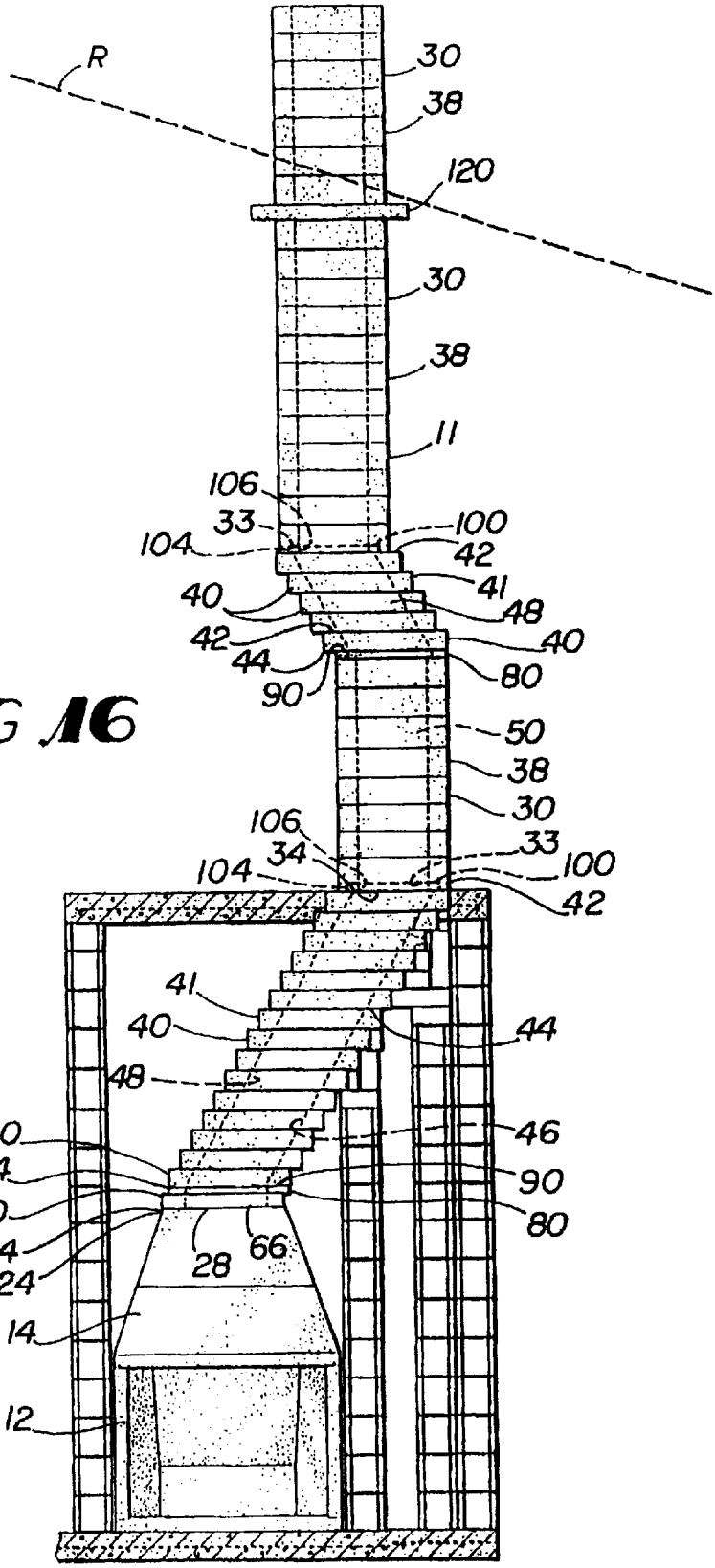
FIG. 16 is a side elevational view of the second embodiment of the present invention showing alternate angled stacks of angled blocks and stacks of modular blocks in the construction of the chimney.

As one skilled in the art will appreciate, and as shown in FIGS. 7 and 16, one or more stacks of blocks 38 and one or more angled stacks of angled blocks 41 may be used in the construction of the chimney 11. As the geometry of the surrounding construction dictates, the angled stack 41, through the use of one spacer block 80 and one filler block 100 described above, is simply interposed between the stacks of blocks 38. Any subsequent angled stacks 41 that are required by the surrounding building construction, may be interposed in a like manner between the stacks of blocks 38. This construction results in a chimney 11 that may have substantially vertical stacks of blocks 38 and angled stacks of angled blocks 41, as desired, that are in fluid communication and that are stackable in a nested relationship for structural security and to provide a substantially no-leak seal so at to eliminate passage of flame and gases through the joints of the chimney 11.

In order to simplify the overall construction of the chimney, the modular chimney 10, 11 of the present invention is made of lightweight concrete composition which can withstand the extreme heat-resistance required of the chimney 10, 11 yet provide the structural strength and lack of brittleness required of the precast modular components. Preferably, the concrete mixture of the modular chimney 10, 11 is selected to form a waterproof, high strength, hard material that has good insulation properties. Cast from this type of material, the completed chimney 10, 11 does not require the addition of a flue liner, thus providing further cost savings in both labor and materials. To achieve such a desired concrete mixture, crushed pumice, type S mortar and glass fibers are mixed with water. After the mixture is cured, it forms a hard material with superior insulation properties when compared to conventional material compositions using Portland cement. Preferably, the desired concrete mixture is a proportional mix of approximately fifteen hundred [1500] lbs. of crushed pumice to approximately thirty [30] gallons of water to approximately three hundred and seventy five [375] lbs. of mortar to approximately one [1] lb. of fibers. As one skilled in the art will appreciate, the modular chimney of the present invention could be constructed of other refractive materials as long the materials provide high strength without brittleness, extreme heat-resistance, good insulation properties, and resistance to the corrosive effect of the combustion products.

All of the joints of the chimney 10, 11 of the present invention are mortared to aid in providing a substantially smoke and flame leak-proof seal. The mortar used is preferably a wet, sticky, air setting, high temperature mortar that combines the two most desirable characteristics of high temperature bonding mortars: smooth, easy workability, and a strong bond for added life and protection to fire/heat proof joints. The preferred mortar is manufactured by the A. P. Green Refractories Co. under the trade name SAIRMIX-7. It is appropriate to trowel the abutting surfaces of the joints of the modular sections of the chimney 10, 11. The joints should be completely covered with 1/16 to 1/8 inch of mortar to secure the joint. The preferred mortar should be used as an adhesive rather than a conventional mortar. After the modular section is set into place, the mortar will push and ooze out of the joint and should be removed to ensure a smooth finish, especially within the chimney passage 50 and the angled chimney passage 48. After completion of the fireplace construction, all of the joints should be "buttered." This procedure involves a final smoothing over and sealing of all joints to assure a substantially leak-proof construction.

Two construction examples of the modular chimney 10, 11 are provided to illustrate the simplicity and ease of construction of the present invention. The first example, as shown in FIG. 15, shows a modular chimney 10 that does not have angled sections. In this example, a fireplace 12 and a smoke chamber 14 have been constructed. The lower surface 64 of the top plate 60 is disposed onto the upper surface 24 of the smoke chamber 14. This allows the top plate bore 66 to be in fluid communication with the exhaust opening 28 of the smoke chamber 14. A modular block 30 is then placed onto the top plate 60. As would be apparent to one skilled in the art, the complementary square shapes of the male top plate protrusion 68 and the female block indentation 33 will aid the orientation of the block 30 to engage and fit snugly onto the top plate 60. This snug fit between the block 30 and the top plate 60 also ensures that the block bore 36 is substantially co-axially aligned with the top plate bore 66.

Subsequent courses of the blocks 30 are then sequentially laid with the female block indentation 33 within the bottom surface 34 of the block 30 engaging and snugly fitting onto the male block protrusion 35 of the previously laid course of the block 30. Similar to the nesting relationship between the top plate 60 and the block 30 that was disposed onto the top plate 60, the nesting relationship of the female block indentation 33 of one block 30 and the male block protrusion 35 of one other block 30 ensures that the stack of blocks 38 formed from the sequential stacking of the blocks 30 forms a substantially smooth and uniform chimney passage 50 in which the block bores 36 are substantially co-axially aligned with each other.

Approaching the roof line R, and preferably about twelve inches below the low side of the roof line R, if an exterior decorative surface treatment such as brick is desired to be applied to the chimney 10, a ledger block 120 is disposed onto the preceding course of the block 30. The female ledger block indentation 127 within the lower surface 124 of the ledger block 120 is placed onto, and complementarily engages, the male block protrusion 35 of the preceding course of the block 30. To continue the chimney 10, the female block indentation 33 within the bottom surface 34 of one of the blocks 30 is then placed onto, and complementarily engages, the male ledger block protrusion 125 extending from the upper surface 122 of the ledger block 120. As discussed above, additional courses of the block 30 may be sequentially applied until the desired height of the chimney 10 is achieved.

Similar to the nesting relationship between adjoining blocks 30, the nesting relationship of the female block indentation 33 of one block 30 and the male ledger block protrusion 125 of the ledger block 120 and the nesting relationship of the male block protrusion 35 of one block and the female ledger block indentation 127 of the ledger block 120 ensures that the sequential stacking of the blocks 30 and the ledger block 120 continues the substantially smooth and uniform chimney passage 50 in which the block bores 36 are substantially co-axially aligned with each other and the ledger block bore 126. As shown in FIG. 15, the ledge surface 129 of the ledger block 120 provides a structural support for the application of an exterior surround of bricks B.

The second example, as shown in FIG. 16, shows a modular chimney 11 that requires angled sections. In this example, a fireplace 12 and a smoke chamber 14 have been constructed. The lower surface 64 of the top plate 60 is disposed onto the upper surface 24 of the smoke chamber 14. This allows the top plate bore 66 to be in fluid communication with the exhaust opening 28 of the smoke chamber 14. If, as shown in FIGS. 10 and 16, an angled section of the chimney 10 is required, a spacer block 80 is used in the transition to the angled section. In this example, the spacer block 80 is placed onto the top plate 60. As one skilled in the art would appreciate, the complementary square shapes of the male top plate protrusion 68 and the spacer block opening 86 will orient the spacer block 80 to engage and fit snugly onto the top plate 60. When the spacer block is engaged with the top plate 60, the substantially level mounting surface 90 provides a structural support for the angled block 40. The angled block bottom surface 44 of one angled block 40 is then oriented and placed onto the mounting surface 90 ensuring that the angled bore 46 of the angled block 40 is positioned over the top plate bore 66 so that the angled bore 46 and the top plate bore 66 are substantially aligned so that the flow of combustion products up the chimney flue is not obstructed.

Subsequent courses of angled blocks 40 are then laid onto each other, with the assembler ensuring that when the angled block bottom surface 44 of one angled block 40 is lowered and fit onto the angled block top surface 42 of a preceding course of the angled block 40, the angled bores 46 of the adjoining angled blocks 40 are substantially co-axial aligned with each other. The sequential stacking of angled blocks 40 forms the substantially smooth and uniform angled chimney passage 48 in which the angled block bores 46 are substantially co-axially aligned with each other.

When the chimney 11 has been sufficiently offset to clear any intervening physical obstruction, a return to the use of the blocks 30 allows the resumption of substantially vertically oriented construction of the chimney 11. When it is desired to return to use of the blocks 30, a filler block 100 is used. The filler block lower surface 104 is placed onto the angled block top surface 42 of the preceding course of the angled block 40 with the assembler ensuring that the filler block bore 106 is aligned with the angled bore 46 of the preceding course of the angled block 40. As one skilled in the art will appreciate, since the filler block 100 is sized and shaped to complementarily engage, and fit within, the female block indentation 33 of the bottom surface 34 of one of the blocks 30, the engagement of the filler block 100 onto the angled block top surface 48 allows the filler block 100 to function in the "nesting relationship" substantially the same as the male block protrusion 35 of the block 30 functions with an adjoining female block indentation 33 of the block 30.

The bottom surface 34 of a block 30 is then placed onto the top surface 48 of the preceding course of the angled block 40 and the top surface 104 of the filler block 100. When the block 30 is seated onto the top surface 48 of the preceding course of angled block 40, the filler block 100, being sized and shaped to complementarily match the female block indentation 33 within the bottom surface of the block 30, is engaged and is snugly fitted within the female block indentation 33. This ensures that the block bore 36 is substantially co-axially aligned with the filler block bore 106 which, in turn, ensures a smooth transition from the angled chimney passage 48 formed by the angled blocks 40 to the chimney passage 50 formed by the blocks 30.

As one skilled in the art will appreciate, and as shown in FIG. 16, the angled block 40 can be used any time that it is it is desired to offset the chimney 11. All that is required is the use of one spacer block 80 and one filler block 100 at the respective beginning and end of any sequential stack of angled blocks 41. The construction and use of subsequent stacks of blocks 38 and the ledger block 120 is the same as described above for the first example, so the description thereof is omitted for the second example.

Although the present invention has been described with reference to specific details of certain embodiments thereof, it is not intended that such details should be regarded as limitations upon the scope of the invention except as and to the extent that they are included in the accompanying claims.

What is claimed is:

1. A chimney for use with a fireplace having a smoke chamber, the smoke chamber having an upper surface defining an exhaust opening, the chimney comprising:

a. a plurality of modular blocks forming at least one stack, each modular block having a first cross-sectional width, a block top surface, and an opposed block bottom surface, wherein the block top surface and the block bottom surface are substantially planar and parallel to each other, each modular block defining a bore having a first diameter extending therethrough between the block top surface and the block bottom surface of each modular block, wherein the block top surface of one modular block is sized to complementarily engage the block bottom surface of one adjacent modular block so that the modular blocks can be sequentially stacked in a nesting relationship in which the bore of each modular block co-axially aligns with the bores of the modular blocks in the stack to form a chimney passage extending through the stack of modular blocks, the chimney passage in fluid communication with the exhaust opening of the smoke chamber; and b. a ledger block having a second cross-sectional width that is greater than the first cross-sectional width of the modular blocks, a ledger block upper surface and an opposed ledger block lower surface, the ledger block defining a ledger block bore having a ledger block diameter substantially the same as the first diameter of the modular block, the ledger block bore extending through the ledger block between the ledger block upper surface and the ledger block lower surface, wherein the plurality of modular blocks includes a first modular block and a second modular block, wherein the ledger block lower surface is sized to be disposed onto and complementarily engage the block top surface of the first modular block and the ledger block upper surface is sized to receive and complementarily engage the block bottom surface of the second modular block that is stacked onto the ledger block, so that the ledger block is in a nesting relationship with the adjacent first and second modular blocks and so that the ledger block chimney bore is in substantial co-axial alignment with the first block bore and the second block bore, and wherein, when the block bottom surface of the second modular block is stacked onto the ledger block, a ledge having a substantially horizontal ledge surface is defined, wherein the ledge extends circumferentially about the chimney at a distance below a roof structure, the ledge surface allowing desired decorative surfacing to be structurally supported when placed onto the ledge surface.

2. The chimney of claim 1, wherein the chimney is made of lightweight concrete formed of water, crushed pumice, Class C fly ash, calcium aluminate, and glass fibers.

3. The chimney of claim 1, wherein the bore of each modular block extends substantially perpendicularly to the block top surface and the block bottom surface.

4. The chimney of claim 3, wherein the block top surface of each modular block includes a male block protrusion extending therefrom and the block bottom surface of each modular block includes a female block indentation therein, wherein the male block protrusion is sized to complementarily engage one female block indentation so that the modular blocks are stackable in the nested relationship.

5. The chimney of claim 1, wherein the ledger block upper surface includes a male ledger block protrusion extending therefrom and the ledger block bottom surface defines a female ledger block indentation therein, and wherein the male ledger block protrusion is sized to complementarily engage the female block indentation of the second block and the female ledger block indentation is sized to complementarily engage the male block extension of the first block so that the blocks and the ledger block are stackable in the nested relationship.

6. The chimney of claim 1, further comprising a top plate having a top plate upper surface and an opposed top plate lower surface, wherein the top plate upper surface and the opposed top plate lower surface are substantially planer and parallel to each other, the top plate lower surface being disposed onto the smoke chamber upper surface, the top plate defining a top plate bore extending therethrough between the top plate upper surface and the top plate lower surface, wherein the plurality of modular blocks includes a third modular block, and wherein the top plate upper surface is sized to complementarily engage the block bottom surface of the third modular block, so that the plurality of modular blocks can be disposed onto the top plate in the nested relationship and so that the top plate bore is in fluid communication with the exhaust opening and the chimney passage and in substantial co-axial alignment with the bore of the third block.

7. The chimney of claim 6, wherein the top plate upper surface includes a male top plate protrusion extending therefrom, wherein the male top plate protrusion is sized to complementarily engage the female block protrusion of the third modular block so that the third modular block can be stacked in the nested relationship.

8. The chimney of claim 1, wherein the bore has a substantially round cross-section in top-plan view.

9. A chimney for use with a fireplace having a smoke chamber, the smoke chamber having an upper surface defining an exhaust opening, the chimney comprising:

a. a plurality of modular blocks forming at least one stack, each modular block having a first cross-sectional width, a block top surface, and an opposed block bottom surface, wherein the block top surface and the block bottom surface are substantially planer and parallel to each other, each modular block defining a bore having a first diameter extending therethrough between the block top surface and the block bottom surface of each modular block, wherein the block top surface of one modular block is sized to complementarily engage the block bottom surface of one adjacent modular block so that the modular blocks can be sequentially stacked in a nesting relationship in which the bore of each modular block co-axially aligns with the bores of the modular blocks in the stack to form a chimney passage extending through the stack, the chimney passage in fluid communication with the exhaust opening of the smoke chamber; and b. a plurality of angled blocks forming at least one angled stack, each angled block having a angled top surface and an opposed angled bottom surface, the angled top surface and the angled bottom surface are substantially planer and parallel to each other, each angled block defining an angled bore extending therethrough between the angled top surface and the angled bottom surface and having an angled bore diameter substantially the same as the first diameter of the block, the angled bore of each angled block extending at an acute angle relative to an axis perpendicular to the angled top and bottom surfaces, wherein the angled top surface of one angled block is sized to complementarily engage the angled bottom surface of one adjacent angled block so that the angled blocks can be sequential stacked so that the angled bore of each angled block co-axially aligns with the angled bores of the angled blocks in the angled stack to form an angled chimney passage extending through the angled stack of blocks, wherein the stack of modular blocks is matingly engaged to the angled stack of angled blocks so that the angled chimney passage is in fluid communication with the chimney passage.

10. The chimney of claim 9, wherein the block top surface of each modular block includes a male block protrusion extending therefrom and the block bottom surface of each modular block includes a female block indentation therein, wherein the male block protrusion is sized to complementarily engage one female block indentation so that the modular blocks can be stacked in the nested relationship.

11. The chimney of claim 10, wherein the chimney is made of lightweight concrete formed of water, crushed pumice, Class C fly ash, calcium aluminate, and glass fibers.

12. The chimney of claim 10, wherein the bore of each modular block extends substantially perpendicularly to the block top surface and the block bottom surface.

13. The chimney of claim 12, further comprising a spacer block having a spacer block upper surface and a spacer block lower surface, the spacer block defining a spacer block opening extending therethrough the spacer block from the spacer block upper surface to the spacer block lower surface, wherein the spacer block opening is sized so that the male block protrusion extending from the block top surface of one modular block may be complementarily engaged by the spacer block opening and so that the male block protrusion and the spacer block upper surface are substantially co-planer, and define a mating surface, when the spacer block lower surface is disposed on to the block top surface of one adjacent block, and wherein the angled bottom surface of one angled block may be engaged to the mating surface so that the angled bore of the angled block is in fluid communication with the bore of the adjacent modular block and the angled chimney passage.

14. The chimney of claim 13, further comprising a filler block having a filler block upper surface and a filler block lower surface, the filler block defining a filler block bore having a filler block diameter substantially the same as the first diameter of the modular block, the filler block bore extending through the filler block between the filler block upper surface and the filler block lower surface, wherein the filler block is sized to complementarily fit within the female block indentation of one modular block so that when the filler block lower surface of the filler block is disposed onto the angled top surface of one angled block, the block bottom surface of a modular block may then be disposed onto the filler block upper surface of the filler block and the angled top surface of the angled block so that one angled block, the filler block, and one modular block can be stacked in the nested relationship, and so that the filler block bore is in substantial coaxial alignment with the bore of the modular block and in fluid communication with the angled chimney passage and chimney passage.

15. The chimney of claim 12, wherein the acute angle of the angled block is 30° or less relative to an axis perpendicular to the angled top surface and angled bottom surface of the angled block.

16. The chimney of claim 12, further comprising a ledger block having a second cross-sectional width that is greater than the first cross-sectional width of the modular blocks, a ledger block upper surface and an opposed ledger block lower surface, the ledger block defining a ledger block bore having a ledger block diameter substantially the same as the first diameter of the modular block, the ledger block bore extending through the ledger block between the ledger block upper surface and the ledger block lower surface, wherein the plurality of modular blocks has a first modular block and a second modular block, and wherein the ledger block lower surface is sized to be disposed onto and complementarily engage the block top surface of the first modular block and the ledger block upper surface is sized to receive and complementarily engage the block bottom surface of the second modular block that is disposed onto the ledger block, so that the ledger block is in a nesting relationship with the adjacent first and second modular blocks with the ledger block chimney bore in substantial coaxial alignment with the first block bore and the second block bore and in fluid communication with the chimney passage.

17. The chimney of claim 16, wherein the ledger block upper surface includes a male ledger block protrusion extending therefrom and the ledger block bottom surface defines a female ledger block indentation therein, and wherein the male ledger block protrusion is sized to complementarily engage the female block indentation of the second modular block and the female ledger block indentation is sized to complementarily engage the male block extension of the first modular block so that the modular blocks and the ledger block are stackable in the nested relationship.

18. The chimney of claim 16, further comprising a top plate having a top plate upper surface and an opposed top plate lower surface, wherein the top plate upper surface and the opposed top plate lower surface are substantially planar and parallel to each other, the top plate lower surface disposed onto the smoke chamber upper surface, the top plate defining a top plate bore extending therethrough the top plate between the top plate upper surface and the top plate lower surface, wherein the plurality of modular blocks includes a third modular block, and wherein the top plate upper surface is sized to complementarily engage the block bottom surface of the third modular block, so that the plurality of modular blocks can be disposed onto the top plate in the nested relationship such that the top plate bore is in fluid communication with the exhaust opening and in substantial co-axial alignment with the third modular block.

19. The chimney of claim 18, wherein the top plate upper surface includes a male top plate protrusion extending therefrom, wherein the male top plate protrusion is sized to complementarily engage one female block protrusion of the third modular block so that the third modular block can be stacked in the nested relationship.

20. The chimney of claim 9, wherein the bore has a substantially round cross-section in top-plan view.

* * * * *